US008971554B2

(12) United States Patent
van Halteren et al.

(10) Patent No.: US 8,971,554 B2
(45) Date of Patent: Mar. 3, 2015

(54) HEARING AID WITH A SENSOR FOR CHANGING POWER STATE OF THE HEARING AID

(71) Applicant: Sonion Nederland BV, Amsterdam (NL)

(72) Inventors: Aart Zeger van Halteren, Hobrede (NL); Nicolaas Maria Jozef Stoffels, Haarlem (NL)

(73) Assignee: Sonion Nederland BV, Amsterdam (NL)

( * ) Notice: Subject to any disclaimer, the term of this patent is extended or adjusted under 35 U.S.C. 154(b) by 0 days.

(21) Appl. No.: 13/722,933

(22) Filed: Dec. 20, 2012

(65) Prior Publication Data

US 2013/0195295 A1 Aug. 1, 2013

Related U.S. Application Data

(60) Provisional application No. 61/579,468, filed on Dec. 22, 2011.

(51) Int. Cl.
*H04R 25/00* (2006.01)

(52) U.S. Cl.
CPC ..... *H04R 25/30* (2013.01); *H04R 25/00* (2013.01); *H04R 2225/021* (2013.01); *H04R 2225/61* (2013.01); *H04R 2460/03* (2013.01)
USPC ..... 381/312; 381/323

(58) Field of Classification Search
CPC ..... H04R 2460/03; H04R 2225/61
USPC ..... 381/312, 313
See application file for complete search history.

(56) References Cited

U.S. PATENT DOCUMENTS

| | | | | |
|---|---|---|---|---|
| 2,899,499 | A | 8/1959 | Eichwald | 381/123 |
| 3,132,208 | A | 5/1964 | Dymski et al. | 381/67 |
| 4,318,245 | A | 3/1982 | Stowell et al. | 46/232 |
| 4,425,481 | A | 1/1984 | Mansgold et al. | 179/107 |
| 4,534,058 | A | 8/1985 | Hower | 381/67 |
| 4,905,498 | A | 3/1990 | O'Donnell et al. | 73/23.1 |
| 4,955,729 | A | 9/1990 | Marx | 381/68 |
| 5,111,506 | A | 5/1992 | Charpentier et al. | 381/68.4 |
| 5,150,310 | A | 9/1992 | Greenspun et al. | 364/516 |
| 5,467,775 | A | 11/1995 | Callahan et al. | 128/715 |

(Continued)

FOREIGN PATENT DOCUMENTS

| | | | |
|---|---|---|---|
| DE | 3508830 | 9/1986 | H04R 25/00 |
| DE | 3716162 | 3/1988 | H04R 25/00 |

(Continued)

*Primary Examiner* — Brian Ensey
*Assistant Examiner* — Norman Yu
(74) *Attorney, Agent, or Firm* — Nixon Peabody LLP

(57) ABSTRACT

A hearing aid comprising a first sensor for sensing a first parameter indicative of a use situation of the hearing aid, wherein the hearing aid is adapted to change into a high power mode or a low power mode in response to the a first control signal from the first sensor. A second sensor for sensing a second parameter indicative of a use situation of the hearing aid may also be used as well.

19 Claims, 3 Drawing Sheets

(56) References Cited

U.S. PATENT DOCUMENTS

| | | | | |
|---|---|---|---|---|
| 5,604,811 | A | 2/1997 | McIntyre et al. | 381/67 |
| 5,818,949 | A | 10/1998 | Deremer et al. | 381/172 |
| 5,903,419 | A | 5/1999 | Smith | 361/56 |
| 6,148,087 | A | 11/2000 | Martin | 381/327 |
| 6,330,339 | B1 * | 12/2001 | Ishige et al. | 381/312 |
| 6,532,294 | B1 * | 3/2003 | Rudell | 381/315 |
| 7,945,297 | B2 * | 5/2011 | Philipp | 455/575.2 |
| 2001/0024505 | A1 | 9/2001 | Torii et al. | 381/123 |
| 2005/0226446 | A1 | 10/2005 | Luo et al. | 381/312 |
| 2009/0097683 | A1 * | 4/2009 | Burns et al. | 381/324 |

FOREIGN PATENT DOCUMENTS

| | | | |
|---|---|---|---|
| EP | 0674466 | 9/1995 | H04R 25/00 |
| JP | 58-57899 | 4/1983 | H01Q 3/24 |
| JP | 1269400 | 10/1989 | H04R 25/00 |
| JP | 4-242400 | 8/1992 | H04R 25/00 |
| JP | 5-344595 | 12/1993 | H04R 25/00 |
| JP | 6-105399 | 4/1994 | H04R 25/00 |
| JP | 8-163700 | 6/1996 | H04R 25/00 |
| JP | 11-275694 | 10/1999 | H04R 25/00 |

* cited by examiner

HEARING AID WITH A SENSOR FOR CHANGING POWER STATE OF THE HEARING AID

REFERENCE TO RELATED APPLICATIONS

This application claims the benefit of U.S. Provisional Patent Application Ser. No. 61/579,468, filed Dec. 22, 2011, and titled "Hearing Aid With A Sensor For Changing Power State Of The Hearing Aid," which is incorporated herein in its entirety.

FIELD OF THE INVENTION

The present invention relates to a hearing aid which is adapted to change from a first power mode to a second power mode in response to a control signal from a sensor.

BACKGROUND OF THE INVENTION

Battery life in a hearing aid is a crucial feature, as changing battery is difficult for users with poor dexterity. Moreover, users with a poor vision have problems changing batteries as the batteries are often small and as the holder into which the battery is inserted is also very small.

Moreover, hearing aids that are adapted to be inserted completely into the auditory canal of the user and remain there for longer periods (e.g., years) will benefit from improved battery life, as the period between changing hearing aids will be extended.

Thus, there is a need for improving the battery life of batteries in hearing aids. Improvement of the battery life may be achieved by providing better batteries or by improving the power consumption of the hearing aid.

Background art may be found in U.S. Publication No. 2005/0226446, which discloses a hearing aid that is capable of automatically switching between a full-function mode and a sleep mode depending on the location of the hearing aid. The hearing aid comprises a hearing aid module for processing an input signal and generating a compensated output signal and, a location sensor module for providing a location information signal to indicate one of an in-the-ear case and an out-of-the-ear case. The hearing aid module automatically switches to the full-function mode when the location information signal indicates the in-the-ear case and the hearing aid module automatically switches to the sleep mode when the location information signal indicates the out-of-the-ear case.

A drawback of a switching scheme based on determining in or out of the ear is that this can result in a false power down, for example, when the hearing aid is only taken out shortly, such as when to reposition the hearing aid. Moreover, this only works for hearing aids that are taken out daily or at least regularly. Use of additional sensors to prevent false power down has been proposed, e.g. U.S. Pat. No. 6,330,339 discloses the use of complex sensors for brain wave or pulse. However, this requires additional processing steps of determining a condition before determining to power down or up, resulting in complex power management schemes.

It is an object of one or more embodiments of the present invention to provide a hearing aid in which the time between battery changes is extended.

SUMMARY OF THE INVENTION

In a first aspect, the present invention relates to a hearing aid comprising a first sensor for sensing a first parameter indicative for a use situation of the hearing aid, wherein the hearing aid is adapted to change into a high power mode or a low power mode in response to the a first control signal from the first sensor.

By providing a hearing aid that is adapted to change a power mode in response to a signal from a sensor of the hearing aid, the battery life may be extended as the hearing aid may power down in periods where the features of the hearing aid are not needed.

In the context of the present invention, the term 'sensor' shall be understood as a device which is capable of measuring a physical quantity and convert it into a signal. In one embodiment, this signal is an electrical signal.

In the context of the present invention, the term 'use situation' shall be understood as a situation relating the specific use of the hearing aid. Examples are insertion of the hearing aid into the auditory canal of a user, presence of the hearing aid in the auditory canal, removal of the hearing aid from the auditory canal, handling of the hearing aid by the user and storage of the hearing aid (e.g., on a table).

The hearing aid may comprise one or more sensors, such as one, two, three, four, five, six, seven, eight, nine etc. The sensors of each hearing aid may be adapted to determine different parameters, e.g. a first sensor may be adapted to determine temperature while another sensor is adapted to determine tilt. In another embodiment, each sensor may be adapted to determine two or more parameters, such as two, three, four, five etc.

Each sensor may be adapted to output a control signal e.g. a first control signal. The signal may be discrete i.e. having distinct and separated value. One example is a sensor having two states such as on and off. Alternatively, the sensor may output a plurality and finite number of discrete values such as three, four, five, six, seven, eight, nine etc. In yet another embodiment, the sensor is adapted to output continuous values.

In one embodiment, the hearing aid defines two power modes—a high and a low power mode—between which the hearing aid may be switched. When this is the case, the hearing aid may be adapted to change from the low power mode to the high power mode (or vice versa) in response to the first control signal from the first sensor. In one embodiment, the (first) sensor is adapted to initiate the change from the low power mode to the high power mode (or vice versa). Alternatively, the hearing aid may comprise more than two power modes, such as three power modes, such as four, such as five, such as six etc. In one embodiment, the hearing aid comprises a high power mode, a low power mode, and a sleep mode.

In one embodiment, the power consumption of the hearing aid (or a processor thereof) is higher in the high power mode than in any of the lower power mode and the sleep mode. Moreover, the lower power mode may be a mode in which the power consumption of the hearing aid (or a processor thereof) is higher than when the hearing aid is operated in the sleep mode.

In one embodiment, the term 'sleep mode' shall designate the least power consuming power mode in which the hearing aid may be awoken by at least one interrupt or a signal from one of the sensors such that the hearing aid changes into a more power consuming mode. In cases where the hearing aid comprises an on/off button, the hearing aid will, in one embodiment, not be in the sleep mode when the hearing aid is turned off by means of the on/off button.

In one embodiment, the term 'sleep mode' shall be a mode in which an amplifier of the hearing aid is not used. Thus, when the hearing aid is changed from the sleep mode into the low power mode or into the high power mode, the amplifier may be activated. In one embodiment, a signal processor of the hearing aid is not used when the hearing aid in the sleep mode and/or in the low power mode.

One example is described in this paragraph: When the hearing aid is in the sleep mode, neither the amplifier nor the signal processor is operated thus causing the power consumption to be low. The result is that no sound is forwarded into the auditory canal of the user. When the hearing aid is operated in the low power mode, the amplifier is operated while the signal processor is not operated. The effect is that the sound forwarded into the auditory canal of the user is only amplified whereby the advantages of the signal processor are not provided. When the hearing aid is in the high power mode, both the signal processor and the amplifier are utilized.

As described previously, the hearing aid may comprise more than one sensor. Thus, in one embodiment, the hearing aid further comprises a second sensor for sensing a second parameter indicative for the use of the hearing aid, and wherein the hearing aid is adapted to change into the high power mode or into the low power mode in response to a second control signal from the second sensor and/or the first control signal from the first sensor. The second parameter may be different from the first parameter. Alternatively, the first and the second parameters are the same. In the latter case, the second sensor may be used as a backup for the first sensor. Alternatively, the two identical sensors may be used to determine the same parameter at different positions of the hearing aid or to determine the same parameter relative to different axes.

The sensors may be adapted to determine a plurality of different parameters. Thus, in one embodiment, at least one of the first parameter and second parameter comprises one or more of:

- an orientation of the hearing aid relative to a predetermined axis, such as relative to the horizontal or the vertical direction, or relative to a plurality of different axes, such as relative to two axes (such as relative to the horizontal and the vertical axes) or three axes,
- movement of the hearing aid, such as in one or more directions such as in one, two or three directions, examples of directions are the horizontal direction and the vertical direction,
- an acceleration of the hearing aid (in one or more directions such as in one, two or three directions) such as in the vertical direction or in a horizontal direction,
- a humidity level (such as the relative humidity),
- a sound level,
- a temperature,
- a rotation of the hearing aid about one or more predetermined axes, such as one axis, such as two axes, such as three axes,
- a rate of rotation of the hearing aid about one or more axes, such as one axis, two axes or three axes, and
- a level of a reflected IR signal, being an indication of the hearing aid residing on the ear or not.

The use of a 3-Dimensional acceleration sensor or sensor assembly according to the invention not only allows determining the acceleration along each separate axis from which e.g. the degree of tilt may be derived. It also allows the determination of an aggregate i.e., total acceleration signal representing a level of activity which can be associated with being awake or asleep.

It will be appreciated that the horizontal direction may extend in any direction in a horizontal plane that defines a normal to the vertical direction. Thus, in some embodiments, the two or more directions may be used as reference directions in the horizontal plane. As an example, one of these directions may be a lateral direction of the person wearing the hearing aid. The term 'lateral direction' shall be understood to mean the direction that defines a normal to the 'Medial Saggital plane'. The term 'Medial Saggital plane' shall be understood as a vertical plane extending through the midline/center of gravity of the body of the user and dividing the body into right and left halves. Moreover, one of the reference directions in the horizontal plane may be a forwards/backwards direction of the user wearing the hearing aid. The term 'forwards/backwards' direction shall be understood as a direction which extends in the 'Medical Saggital plane' while at the same time defining a normal to the vertical direction.

In cases where the hearing aid comprises a first and a second sensor that are adapted to output a first and a second parameter, the hearing aid may be adapted to change between two of the high power mode, the low power mode and the sleep mode in response to the first control signal and/or second control signal. As an example, the first sensor may be a tilt sensor and the second sensor may be a microphone. In the example, the hearing aid may be adapted to change into the sleep mode or the low power mode if no sound is detected and the tilt sensor indicates that the person using the hearing aid is lying down. While the person is lying down, the hearing aid may be adapted to change into the high power mode when the sound is detected by means of the microphone. Similarly, the hearing aid—when the person is lying down—may be adapted to change into the high power mode when the tilt sensor indicated that the person is no longer lying down (this may be the case if the person is sitting in the bed or if the person is standing up).

Accordingly, the hearing aid may be adapted to change not only into one of the three modes but also between at least two of them. Accordingly, the hearing aid may be adapted to change between two of the high power mode, the low power mode and the sleep mode in response to a predetermined combination of the first and the second control signal. It will be appreciated that the hearing aid may also be adapted to change between the three modes.

The tilt sensor described above may be adapted to determine an orientation of the hearing aid, e.g. relative to a predetermined direction. As an example, the tilt sensor may be adapted to determine the orientation of the hearing aid relative to the horizontal and/or the vertical direction. Accordingly, in one embodiment, one of the first and the second parameter is an orientation of the hearing aid. Moreover, the hearing aid may be adapted to change into the high power mode in response to a change in the orientation of the hearing aid into a substantially vertical orientation corresponding to the user standing up. Alternatively, or as a supplement, the hearing aid may be adapted to change into the low power mode (or the sleep mode) in response to a change in the orientation of the hearing aid into a substantially horizontal orientation corresponding to the user lying down.

As described previously, one of the first and the second parameters may be a sound level in the vicinity of the hearing aid. When this is the case, the hearing aid may be adapted to change into the high power mode when the sound level increases with a predetermined percentage and/or to a level above a predetermined upper sound level. Moreover, the hearing aid may be adapted to change to the high power mode when predetermined sounds are determined independent of the sound level thereof. One example is an alarm sound and it will be appreciated that by providing a hearing aid which is adapted to change into high power mode when an alarm is detected may save lives.

Moreover, when one of the first and the second parameter is a sound level in the vicinity of the hearing aid, the hearing aid may be adapted to change into a low power mode when the sound level decreases with a predetermined percentage and/or to a level below a predetermined lower sound level.

It will be appreciated that, the hearing aid may change into the low power mode or the sleep mode when it is not in use. In order to determine this, the hearing aid may be adapted to determine when the hearing aid is not provided in an auditory canal of a user and to change into the sleep mode or the low power mode when this is the case and/or to change into the high power mode when this is not the case. In order to determine whether the hearing aid is provided in the auditory canal, the hearing aid may comprise a proximity sensor which is adapted to determine whether a predetermined surface of the hearing aid is in direct contact with the skin or a mucous membrane of the user. As the humidity in the auditory canal is normally higher than outside the auditory canal, the hearing aid may comprise a humidity sensor which is adapted to determine the humidity. This may be used to determine whether the hearing aid is provided in the auditory canal.

It will be appreciated that, in some case, the user takes the hearing aid out only to adjust it and not to leave it on a table. Thus, in these cases, the hearing aid will be provided in the auditory canal relatively soon after being removed from the auditory canal. In this case, it may be desirable not to power down the hearing aid, and thus the hearing aid may comprise a sensor adapted to determine movement of the hearing aid. Thus, if the hearing aid is determined not to be positioned in the auditory canal, the hearing aid may refrain from turning into the sleep or low-power mode, if at the same time, it is determined that the hearing aid is being moved about. The movement sensor may also be used to determine whether the user sleeps or not. Most likely, a person sleeping will lie still (most of the time or at least for longer periods). Thus, if the hearing aid determines that the hearing aid is not being moved about, it may be adapted to change into the low-power mode or the sleep mode. Similarly, the hearing aid may be adapted to change into the high power mode when the movement sensor indicates that the hearing aid is being moved about.

In one embodiment, the determination of the presence in the auditory canal is based on a control signal from one or more of a temperature sensor and a 3-axis acceleration sensor. By providing a temperature sensor, it may easily be determined whether the hearing aid is provided inside the auditory canal where the temperature normally is higher than in the surroundings of the user of the hearing aid.

In one embodiment, the hearing aid comprises a tilt sensor which is adapted to determine an orientation of the hearing aid relative to a predetermined axis. Alternatively, or as a supplement, the hearing aid may comprise a movement sensor that is adapted to determine movement of the hearing aid in at least one direction. Alternatively, or as a supplement, the hearing aid may comprise an acceleration sensor which is adapted to determine acceleration of the hearing aid in at least one direction. Alternatively, or as a supplement, the hearing aid may comprise a humidity sensor that is adapted to determine the humidity in the vicinity of the hearing aid. Alternatively, or as a supplement, the hearing aid may comprise a microphone.

In one embodiment, the hearing aid comprises an air pressure sensor which is adapted to determine the air pressure in the vicinity of the hearing aid. If the air pressure sensor determined a sudden increase in pressure followed by a sudden decrease in pressure, this may be an indication that the user has laid down on a pillow. This may be used to indicate that the user is or will soon be sleeping.

In one embodiment, the microphone of the hearing aid is used to determine whether the user is snoring by analysing the received sound and determining whether the sound in within a predetermined frequency range. Moreover, the hearing aid may be adapted to determine wind noise which may be used as an indication that the user most likely is awake and moving around outdoors.

In one embodiment, the hearing aid is adapted to determine the conductivity between two points on its surface. It will be appreciated that when the hearing aid is not in direct contact with the skin of the user, the conductivity between the two points will be zero or substantially zero. However, this changes when the hearing aid is in use and, thus, the lack of conductivity may be used as an indication of the hearing aid being removed.

In one embodiment, the hearing aid may comprise a light intensity sensor. If no light is determined, it may be an indication of the user sleeping. In addition, the hearing aid may be set up to take a predetermined low level of light as indication of the user sleeping. A low level of light being the level of light associated with a sleeping environment.

In one embodiment, the hearing aid may comprise a gyroscope as a sensor for rotation and/or rate rotation.

In one embodiment, the hearing aid may comprise an IR reflection sensor. If reflection is below a threshold level, the hearing aid is regarded as not placed on or in the ear.

Finally, it will be appreciated that in some embodiments, the hearing aid may be adapted to change from one mode to another mode only if a plurality of sensors indicates the same use situation. By checking a plurality of sensors and only changing mode if a plurality of sensors indicates the same use situation, unwanted changes may be prevented. For example, the user may move about in the dark and, thus, by not only relying on the light intensity sensor it may be prevented that the hearing aid changes into the low power mode or even the sleep power mode in a situation where the user wishes to use the hearing aid.

In a second aspect, the present invention relates to a method of controlling a hearing aid comprising a first sensor for sensing a first parameter indicative for a use situation of the hearing aid, the method comprising:

determining a first control signal of the first sensor, and changing the hearing aid into a high power mode or a low power mode in response to the first control signal from the first sensor.

It will be appreciated that the invention according to the second aspect may comprise any combination of features and/or elements of the invention according to the first aspect.

BRIEF DESCRIPTION OF THE DRAWINGS

The invention will now be described with reference to the figures in which.

Figure 1:
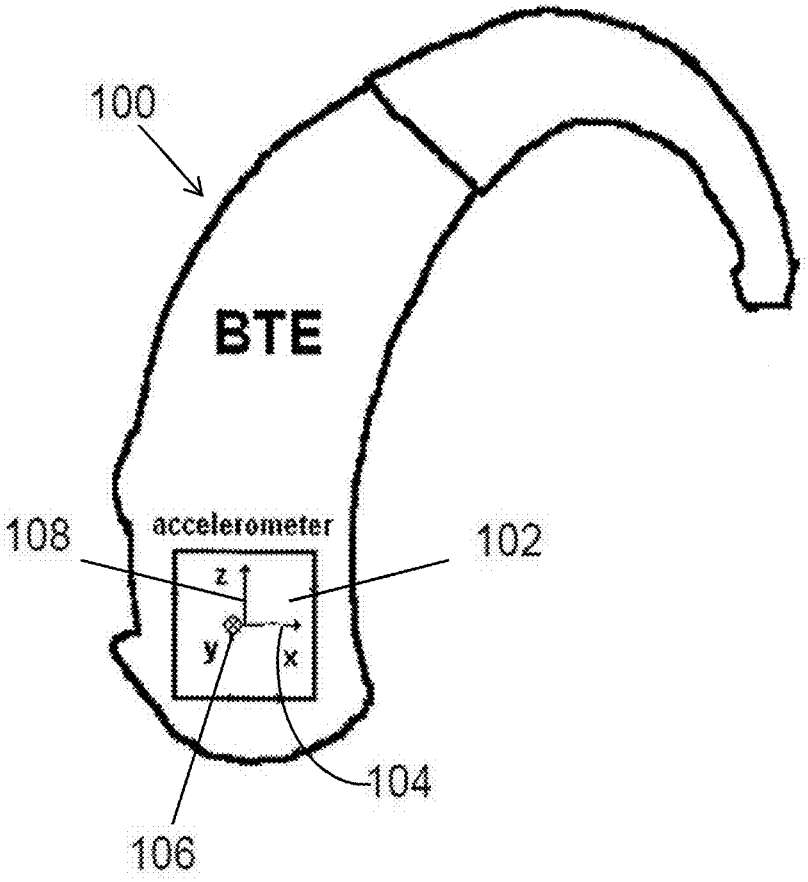
FIG. 1 discloses a hearing aid comprising an accelerometer.

While the invention is susceptible to various modifications and alternative forms, a specific embodiment have been shown by way of an example in the drawing and will be described in detail herein. It should be understood, however, that the invention is not intended to be limited to the particular form disclosed. Rather, the invention is to cover all modifications, equivalents, and alternatives falling within the spirit and scope of the invention as defined by the appended claims.

DETAILED DESCRIPTION OF THE DRAWINGS

FIG. 1 discloses a hearing aid 100 in the form of a behind-the-ear device. The hearing aid comprises an accelerometer 102 which in the embodiment of FIG. 1 is a three-dimensional accelerometer which is adapted to determine the acceleration of the hearing aid 100 in an x-direction 104, a y-direction 106 and a z-direction 108. The hearing aid 100 may be adapted to compare the acceleration in the three directions 104,106,108 with the earth gravity so as to determine the orientation of the hearing aid and the use situation. As an example, the hearing aid may be adapted to determine whether the user is standing up or lying down by use of the accelerometer 102.

When a user stands up while wearing the hearing aid of FIG. 1, the z-direction of the hearing aid corresponds to the vertical direction, the y-direction corresponds to the lateral direction and the x-direction corresponds to the forwards/backwards direction.

In one embodiment, the hearing aid 100 is adapted to determine (a) whether the angle between the hearing aid and the vertical direction exceeds a predetermined threshold. Moreover, the hearing aid 100 may be adapted to determine (b) by means of the accelerometer, whether the hearing aid is moving or not. When conditions (a) and (b) are positive, it may be an indication of the user lying down and sleeping and thus the hearing aid 100 may be adapted to change into the low power mode or a sleep mode. This may either be done instantly upon detection of conditions (a) and (b) being positive or after a predetermined period of time.

Figure 2:
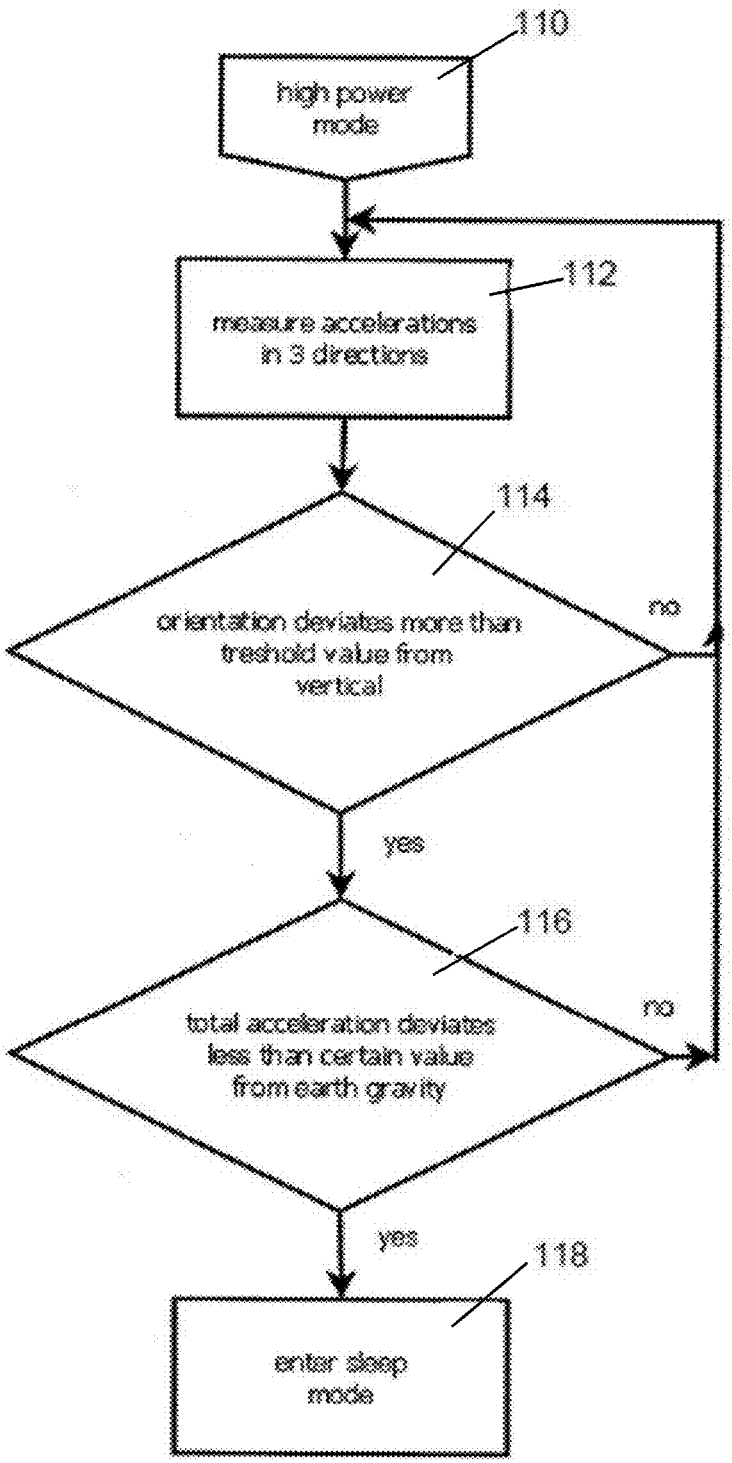
FIG. 2 discloses the steps in a method where a hearing aid is changed from a high power mode into a sleep mode, and FIG. 3 discloses the steps in a method where a hearing aid is changed from a sleep mode into a high power mode.

FIG. 2 discloses an embodiment of the steps (of a method) carried out by the hearing aid in order to change from the high power mode into the low power mode or the sleep mode. Initially, the hearing aid is in the high power mode (Step 110).

Then, the hearing aid 100 determines the acceleration in the three directions (Step 112).

Subsequently, it is determined whether the orientation of hearing aid deviates from the vertical direction (Step 114). This may be done by means of the output from the accelerometer. It will be appreciated that when the z-axis of the accelerometer is aligned with the vertical direction and the hearing aid is not moved about, the values for the x-axis and the y-axis are zero or close thereto. Moreover, it will be appreciated that when the z-axis of the hearing aid is not parallel to the vertical direction, the gravitational acceleration will be divided over at least one of the x-direction and the y-direction. If the determination in Step 114 is negative, then the Step 112 is repeated. If the determination in Step 114 is positive, then the method according to FIG. 2 continues to Step 116.

In Step 116, it is determined whether the total acceleration (i.e., the resulting acceleration determined by the measurements from each of the x-axis, the y-axis and the z-axis) deviates from less than a certain value from the earth gravity acceleration. If the latter is not the case, the Step 112 is repeated. If, on the other hand, the determination in Step 114 is positive, then the hearing aid 100 enters sleep mode (Step 118).

Figure 3:
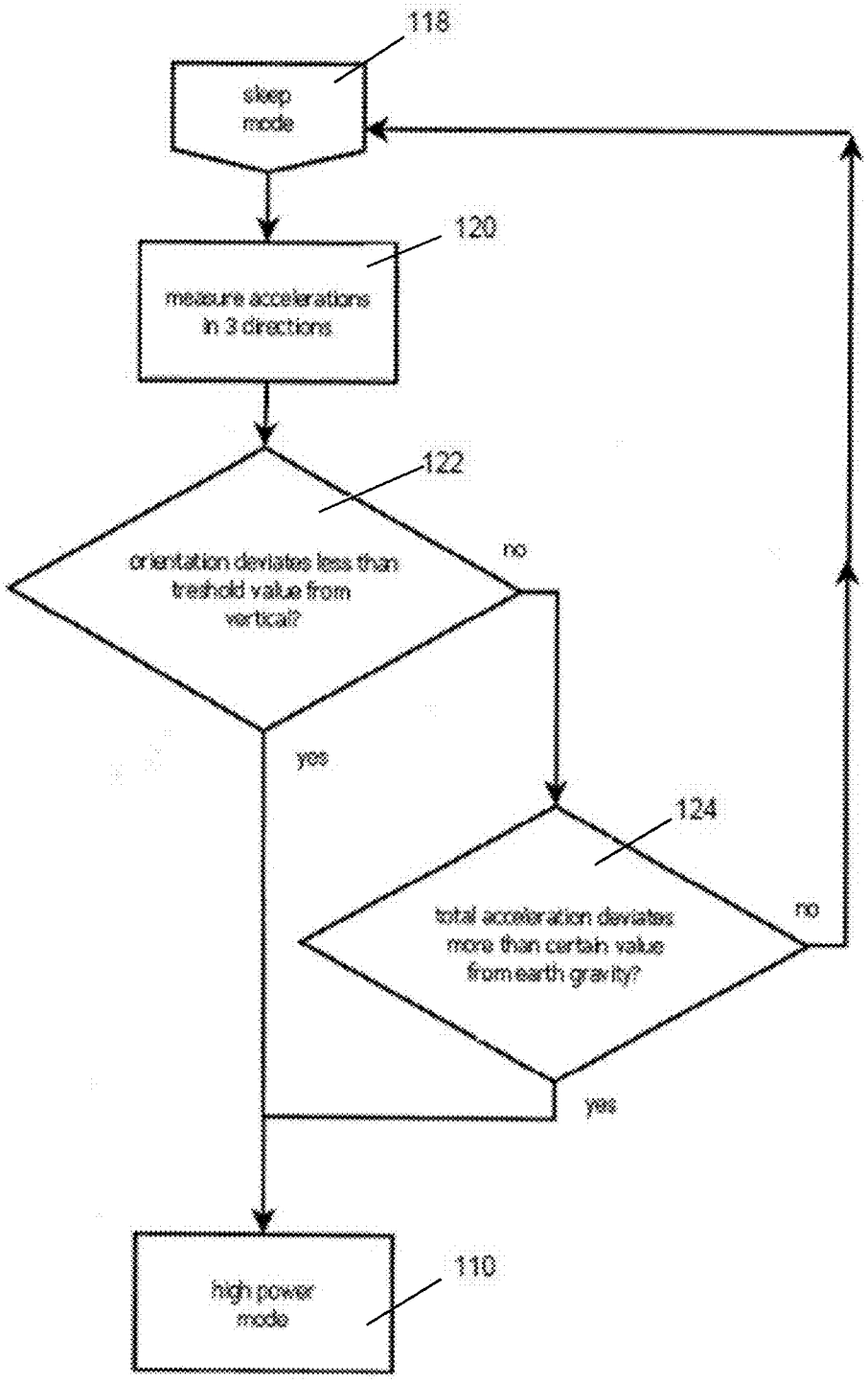

FIG. 3 discloses an embodiment of steps (of a method) which are carried out by the hearing aid in order to change from the low power mode into the high power mode. Initially, the hearing aid is in the sleep mode (Step 118). Then, the hearing aid measures the acceleration in the three directions (Step 120).

Subsequently, the hearing aid determines whether the orientation of hearing aid the deviates less than a predetermined threshold value relative to the vertical direction (Step 122). As was the case with Step 114 of FIG. 2, this may be done by means of the output from the accelerometer. Again, if the z-axis of the accelerometer is aligned with the vertical direction and the hearing aid is not moving about, then the values of the x-axis and the y-axis are zero or close thereto. If, on the other hand, the z-axis is not parallel with the vertical direction, the gravitational acceleration will be divided over at least one of the x-direction and the y-direction. If the determination of Step 122 is positive, then the hearing aid changes into the high power mode (Step 110). If, on the other hand, the determination of Step 122 is negative, then the method of FIG. 3 continues to Step 124.

In Step 124, it is determined whether the total acceleration deviates from more than a predetermined value from the earth gravity acceleration. If this is not the case, then the method continues with the Step 118. If, on the other hand, it is the case, then the hearing aid changes into the high power mode (Step 110).

In the following two further embodiments are described.

Embodiment A (Deep Fit Hearing Aids):

Embodiment A relates to deep fit hearing aids, i.e. hearing aids that are positioned so far into the auditory canal that the user cannot remove the hearing aid himself or he can only remove the hearing aid by means of a tool. As the hearing aid is positioned so deep into the auditory canal it will normally not be possible for the user to change the mode of the hearing aid, as in the normal use situation the hearing aid is not easily accessible.

If the user is lying down, the hearing aid may be adapted to change into a stand-by mode. In order to determine whether the user is lying down, the orientation of the hearing aid may be monitored, cf. the previously example with the accelerometer.

While the hearing aid is in the stand-by mode, it may shut down (or just not use) the signal processing means. Moreover, the hearing aid may be adapted to monitor the sound level while operated in the stand-by mode. If the sound level is above a predetermined level, the hearing aid may be adapted to change into the high power mode.

Moreover, the hearing aid may be adapted to change into the high power mode when it detects that the user stands up again.

Embodiment B (Non-Deep Fit Hearing Aids):

Embodiment B relates to any non-deep-fit hearing aid, i.e. a hearing aid which is easily accessible by the user and thus allows for the user to change the state of the hearing aid. The latter may be advantageous if the user desires to override a power mode, e.g., by forcing the hearing aid into the sleep mode or by forcing the hearing aid into the high power mode.

The hearings aid of embodiment A may be adapted to change into the sleep mode or to power off when the hearing aid is removed from the ear. The hearing aid may be adapted to determine when it is removed from the ear by means of one or more of the following: (1) by determining tilt of the hearing aid, (2) by means of an accelerometer as described previously, (3) by determining the temperature in the vicinity of the hearing aid, (4) by determining the humidity in the vicinity of the hearing aid. If one or more of the tests (1) to (4) is/are positive, the hearing aid may be adapted to power off.

In the case of test (3), it will be appreciated that if the temperature in the vicinity of the hearing aid is close to the body temperature of a human being then there is a great likelihood of the hearing aid being inserted into the auditory canal or being placed behind the ear of the user. In the case of test (4), it will be appreciated that the likelihood of the hearing aid being placed in the auditory canal or behind the ear is greater if the humidity is high. Thus if the humidity suddenly increases, the hearing aid may be used again by the user.

The hearing aid according to embodiment B may be adapted to power on again if it determines that the hearing aid has been inserted into the auditory canal again or has been placed behind the ear again. This may be done by means of the tests (1) to (4). However, it will be appreciated that in this case the test are reversed in that if the result of the test is the inverse/opposite as the above described the hearing aid will power on. As an example, the hearing aid may be adapted to change into the high power mode if the temperature in the vicinity of the hearing aid is elevated to the body temperature.

It should be understood, however, that the invention is not intended to be limited to the particular form disclosed in relation to aforementioned figures. Rather, the invention is to cover all modifications, equivalents, and alternatives falling within the spirit and scope of the invention as defined by the appended claims.

What is claimed is:

1. A hearing aid comprising a first sensor for sensing a first parameter indicative of a use situation of the hearing aid, the hearing aid defining a direction parallel to the vertical direction when in a use situation, wherein the hearing aid is configured to change into a high power mode or a low power mode in response to a first control signal from the first sensor, wherein the first sensor is a three-axis accelerometer having one axis aligned with the defined direction, and wherein the hearing aid changes from the high power mode to the low power mode by:

measuring accelerations of the hearing aid in three directions from the first sensor;

determining whether an orientation of the hearing aid deviates more than a threshold value from vertical;

determining whether a total acceleration of the hearing aid deviates less than a predetermined value from earth's gravity; and changing the hearing aid from the high power mode to the low power mode when the orientation deviates more than the threshold value from vertical and the total acceleration deviates less than the predetermined value from earth's gravity in response to the first control signal from the first sensor.

2. A hearing aid according to claim 1, further comprising a second sensor for sensing a second parameter indicative of the use of the hearing aid, and wherein the hearing aid is adapted to change into the high power mode or into the low power mode in response to a second control signal from the second sensor and/or the first control signal from the first sensor.

3. A hearing aid according to claim 2, wherein at least one of the first parameter and second parameter comprises one or more of: an orientation of the hearing aid relative to a predetermined axis, a movement of the hearing aid, an acceleration of the hearing aid, a humidity level, a sound level, and a temperature.

4. A hearing aid according to claim 1, wherein the hearing aid is adapted to change between the high power mode and the low power mode in response to the first control signal and/or a second control signal.

5. A hearing aid according to claim 2, wherein the hearing aid is adapted to change between the high power mode and the low power mode in response to a predetermined combination of the first and the second control signals.

6. A hearing aid according to claim 2, wherein one of the first and the second parameters is an orientation of the hearing aid, and wherein the hearing aid is adapted to change into the high power mode in response to a change in the orientation of the hearing aid into a substantially vertical orientation.

7. A hearing aid according to claim 2, wherein one of the first and the second parameters is an orientation of the hearing aid, and wherein the hearing aid is adapted to change into the low power mode in response to a change in the orientation of the hearing aid into a substantially horizontal orientation.

8. A hearing aid according to claim 2, wherein one of the first and the second parameter is a sound level in the vicinity of the hearing aid, and wherein the hearing aid is adapted to change into the high power mode when the sound level increases with a predetermined percentage and/or to a level above a predetermined upper sound level.

9. A hearing aid according to claim 2, wherein one of the first and the second parameter is a sound level in the vicinity of the hearing aid, and wherein the hearing aid is adapted to change into a low power mode when the sound level decreases with a predetermined percentage and/or to a level below a predetermined lower sound level.

10. A hearing aid according to claim 1, wherein the hearing aid is adapted to determine when the hearing aid is not positioned in an auditory canal of a user and to change into the low power mode when the hearing aid is not positioned in the auditory canal.

11. A hearing aid according to claim 10, further comprising a second sensor, wherein the second sensor is a temperature sensor, and the determination of the position in the auditory canal is based on the first control signal from one or more of the temperature sensor and the 3-axis acceleration sensor.

12. A hearing aid according to claim 1, wherein the hearing aid is adapted to determine when the hearing aid is positioned in an auditory canal of a user and to change into the high power mode when the hearing aid is positioned in the auditory canal.

13. A hearing aid according to claim 12, further comprising a second sensor, wherein the second sensor is a temperature sensor and the determination of the position in the auditory canal is based on the first control signal from one or more of the temperature sensor and the 3-axis acceleration sensor.

14. A hearing aid according to claim 1, wherein the first sensor is a tilt sensor that is adapted to determine an orientation of the hearing aid relative to a predetermined axis.

15. A hearing aid according to claim 1, wherein the first sensor is a movement sensor that is adapted to determine movement of the hearing aid in at least one direction.

16. A hearing aid according to claim 1, further comprising a humidity sensor that is adapted to determine the humidity in the vicinity of the hearing aid.

17. A hearing aid according to claim 1, further comprising a microphone.

18. A method of controlling a hearing aid comprising a sensor for sensing a first parameter indicative of a user situation of the hearing aid, the hearing aid defining a direction parallel to the vertical direction when in a user situation and the sensor being a three-axis accelerometer having one axis aligned with the defined direction, the method comprising:

measuring accelerations of the hearing aid in three directions;

determining whether an orientation of the hearing aid deviates more than a threshold value from vertical;

determining whether a total acceleration of the hearing aid deviates less than a predetermined value from earth's gravity; and changing the hearing aid from a high power mode to a low power mode, when the orientation deviates more than the threshold value from vertical and the total acceleration deviates less than the predetermined value from earth's gravity in response to the first control signal from the first sensor.

19. A method of controlling a hearing aid comprising a sensor for sensing a first parameter indicative of a user situation of the hearing aid, the hearing aid defining a direction parallel to the vertical direction when in a user situation and sensor being a three-axis accelerometer having one axis aligned with the defined direction, the method comprising:

measuring accelerations of the hearing aid in 3 directions;

determining whether an orientation of the hearing aid deviates more than a threshold value from vertical;

determining whether a total acceleration of the hearing aid deviates less than a predetermined value from earth's gravity; and maintaining the hearing aid in low power mode as long as the determined orientation does not exceed the threshold value and the determined acceleration deviates less than the value from earth's gravity.

* * * * *